US011090965B2

(12) United States Patent
Nishiura et al.

(10) Patent No.: US 11,090,965 B2
(45) Date of Patent: Aug. 17, 2021

(54) METHOD OF FORMING A STRUCTURE, STRUCTURE FORMING APPARATUS, COMPUTER READABLE STORAGE MEDIUM AND PROCESSING MEDIUM FOR FORMING A STRUCTURE

(71) Applicant: CASIO COMPUTER CO., LTD., Tokyo (JP)

(72) Inventors: Fusao Nishiura, Iruma (JP); Hideaki Terada, Fuefuki (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 169 days.

(21) Appl. No.: 16/371,737

(22) Filed: Apr. 1, 2019

(65) Prior Publication Data

US 2019/0224999 A1 Jul. 25, 2019

Related U.S. Application Data

(62) Division of application No. 15/208,076, filed on Jul. 12, 2016, now Pat. No. 10,286,703.

(30) Foreign Application Priority Data

Sep. 30, 2015 (JP) ..... 2015-193163
Jan. 29, 2016 (JP) ..... 2016-015518

(51) Int. Cl.
*B41M 3/06* (2006.01)
*B41J 3/407* (2006.01)
(Continued)

(52) U.S. Cl.
CPC ..... *B41M 3/06* (2013.01); *B41J 3/407* (2013.01); *B41J 11/002* (2013.01); *B41M 3/001* (2013.01);
(Continued)

(58) Field of Classification Search
CPC ..... B41J 11/002
See application file for complete search history.

(56) References Cited

U.S. PATENT DOCUMENTS

2001/0014381 A1 8/2001 Kaneko et al.
2012/0218338 A1 8/2012 Kanamura et al.

FOREIGN PATENT DOCUMENTS

JP 01028659 A 1/1989
JP 02190379 A 7/1990
(Continued)

OTHER PUBLICATIONS

JP2001150812, 2001, Machine Translation. (Year: 2001).*
(Continued)

*Primary Examiner* — Robert A Vetere
(74) *Attorney, Agent, or Firm* — Holtz, Holtz & Volek PC

(57) ABSTRACT

A structure forming apparatus includes a printing unit which prints a photo-thermal conversion material, a white material, and a coloring material in order on an expanding layer in an overlapping manner, where the expanding layer is expanded when heated with thermal energy of light. The apparatus also includes a heating unit which irradiates light on the expanding layer from a side of the coloring material to expand the expanding layer, and a controlling unit which sets a printing density of the photo-thermal conversion material lower by a level corresponding to a quantity of heat conducted from the coloring material than the printing density of the photo-thermal conversion material to be printed when the coloring material has no photo-thermal conversion characteristic in the case in which the coloring material has photo-thermal conversion characteristic, and prints the photo-thermal conversion material of the set printing density.

10 Claims, 7 Drawing Sheets

(51) Int. Cl.

| | |
|---|---|
| ***B41J 11/00*** | (2006.01) |
| ***B41M 3/00*** | (2006.01) |
| ***B41M 3/16*** | (2006.01) |
| ***B41M 7/00*** | (2006.01) |

(52) U.S. Cl.
CPC ..... *B41M 3/006* (2013.01); *B41M 3/16* (2013.01); *B41M 7/009* (2013.01)

(56) References Cited

FOREIGN PATENT DOCUMENTS

| | | | | |
|---|---|---|---|---|
| JP | 09207428 | A | | 8/1997 |
| JP | 2001150812 | A | | 6/2001 |
| JP | 2001150812 | A | * | 11/2002 |
| JP | 2014083740 | A | * | 5/2014 |
| JP | 2014083740 | A | | 5/2014 |

OTHER PUBLICATIONS

JP2014083740, 2014, Machine Translation. (Year: 2014).*
Japanese Office Action dated Apr. 17, 2018 issued in counterpart Japanese Application No. 2016-015518.

* cited by examiner

METHOD OF FORMING A STRUCTURE, STRUCTURE FORMING APPARATUS, COMPUTER READABLE STORAGE MEDIUM AND PROCESSING MEDIUM FOR FORMING A STRUCTURE

CROSS-REFERENCE TO RELATED APPLICATION

This application is a Divisional application of U.S. application Ser. No. 15/208,076, filed, Jul. 12, 2016, which is based upon and claims the benefit of priority from prior Japanese Patent Application Nos. 2015-193163, filed Sep. 30, 2015, and 2016-015518, filed Jan. 29, 2016. The entire contents of all the above-identified applications are incorporated herein by reference.

BACKGROUND OF THE INVENTION

1. Field of the Invention

The present invention relates to a method of forming a structure, structure forming apparatus, computer readable storage medium and processing medium for forming a structure.

2. Description of the Related Art

A method of forming a foamed structure is disclosed in Japanese Unexamined Patent Publication No. 2001-150812. This foamed structure forming method prepares a medium with an expanding layer provided on its one surface, wherein the expanding layer is expanded, when heated, and forms a shading image in an intended area on the other surface of the medium and then heats the medium where the shading image is formed, expanding the expanding layer of the medium where the shading image formed. But the Japanese Unexamined Patent Publication No. 2001-150812 discloses nothing about a method of forming a foamed structure, which forms a visible flat image such as a color image on the surface of the medium on the same side as the expanding layer is provided, before the expanding layer of the medium is expanded, and forms an image on the expanded layer after the expanding layer of the medium is expanded.

When printing is performed on the medium after the surface of the medium has been expanded, since the surface of the medium is expanded, it is hard to perform printing on such medium using a printing system such as an offset printing system which performs printing at a printing speed relatively higher than an ink-jet printing system. For instance, since the printer of the ink-jet printing system, which are widely used among general households, are designed on the premise that they are used to perform printing on a flat surface of a printing medium, it is hard for the printer of the ink-jet printing system to perform printing on the expanded irregular surface of the printing medium while maintain an enhanced printing quality. When the printer of the ink-jet printing system is used to perform printing on the irregular surface of the medium, it is required to use a special printer in place of the versatile printer to maintain an enhanced quality in printing.

SUMMARY OF THE INVENTION

The present invention provides a method of forming a structure, structure forming apparatus, and processing medium, which allow to use a printer of the offset printing system to perform an enhanced-quality printing while reducing a time required for forming a structure, or which can form the structure which reproduces an intended original tint of color at enhanced quality, even though the versatile printer of the ink-jet printing system and/or of the laser printing system is used, which is designed on the premise of performing printing on a flat surface of a printing medium.

According to one aspect of the invention, there is a method of forming a structure, which comprises a step of forming a photo-thermal conversion material on a medium having an expanding layer by printing, before the expanding layer is expanded, wherein the expanding layer is expanded when heated, a step of forming at least one of a white material and a coloring material on the photo-thermal conversion material formed on the medium by printing, and a step of expanding the expanding layer by heating.

According to another aspect of the invention, there is provided a structure forming apparatus which comprises a first forming unit which forms a photo-thermal conversion material on a medium having an expanding layer by printing, before the expanding layer is expanded, wherein the expanding layer is expanded when heated, a second forming unit which forms at least one of a white material and a coloring material on the photo-thermal conversion material by printing, after the photo-thermal conversion material is formed on the medium by the first forming unit, and a heating unit which expands the expanding layer by heating, after at least one of the white material and the coloring material is formed on the photo-thermal conversion material by the second forming unit.

According to other aspect of the invention, there is provided a non-transitory computer readable storage medium with an executable program stored thereon, the storage medium being mounted on a structure forming apparatus having a computer, a first forming unit, a second forming unit, and a heating unit, wherein the executable program, when installed on the computer, makes the computer instruct the first forming unit to form a photo-thermal conversion material on a medium having an expanding layer by printing, before the expanding layer is expanded, wherein the expanding layer is expanded when heated, the second forming unit to form at least one of a white material and a coloring material on the photo-thermal conversion material by printing, after the photo-thermal conversion material is formed on the medium by the first forming unit, and the heating unit to expand the expanding layer by heating, after at least one of the white material and the coloring material is formed on the photo-thermal conversion material by the second forming unit.

According to yet another aspect of the invention, a processing medium for forming a structure, which comprises a medium having an expanding layer, wherein the expanding layer has a flat surface and is expanded, when heated, a photo-thermal conversion material formed on the medium, and at least one of a white material and a coloring material formed on the photo-thermal conversion material.

In the method of forming a structure, structure forming apparatus, and processing medium according to the embodiment of the invention, a printer of the offset printing system can be used to perform an enhanced-quality printing while reducing a time required for forming a structure, or the structure can be formed, which reproduces an intended original tint of color at high quality, even though a versatile printer of the ink-jet printing system and/or of the laser printing system is used, which is designed on the premise of performing printing on a flat surface of a printing medium.

DETAILED DESCRIPTION OF THE PREFERRED EMBODIMENTS

Figure 1A:
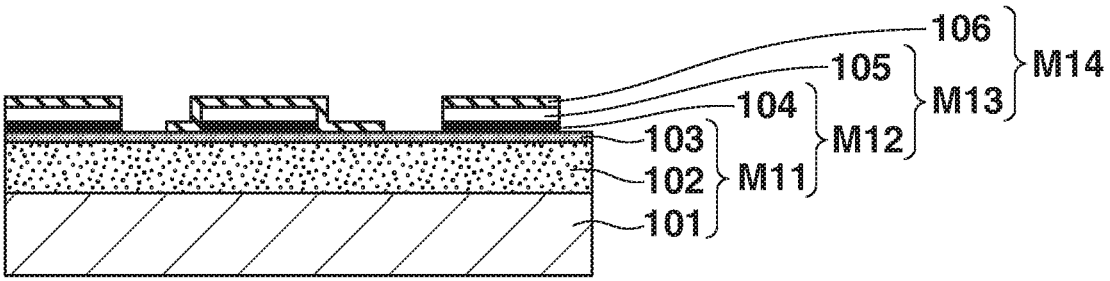
FIG. 1A is a cross-sectional view showing a processing medium for forming a structure according to the embodiments of the invention.

FIG. 1A is a cross-sectional view showing a processing medium M14 for forming a structure according to the embodiments of the invention.

Figure 1B:
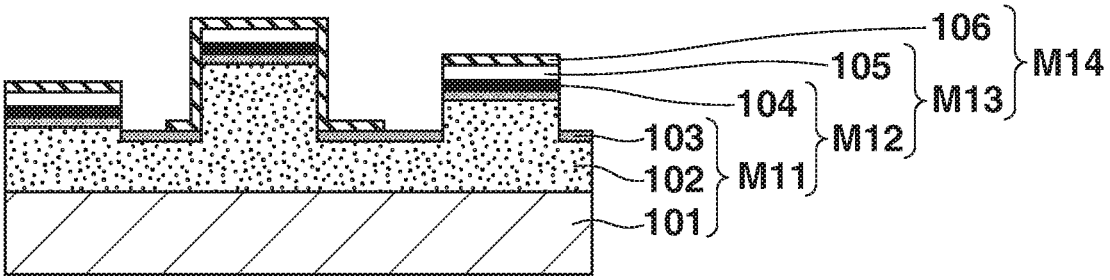
FIG. 1B is a cross-sectional view showing an expanded processing medium for forming a structure according to the embodiments of the invention.

FIG. 1B is a cross-sectional view showing a structure (the expanded processing medium for forming a structure) according to the embodiments of the invention.

Figure 2:
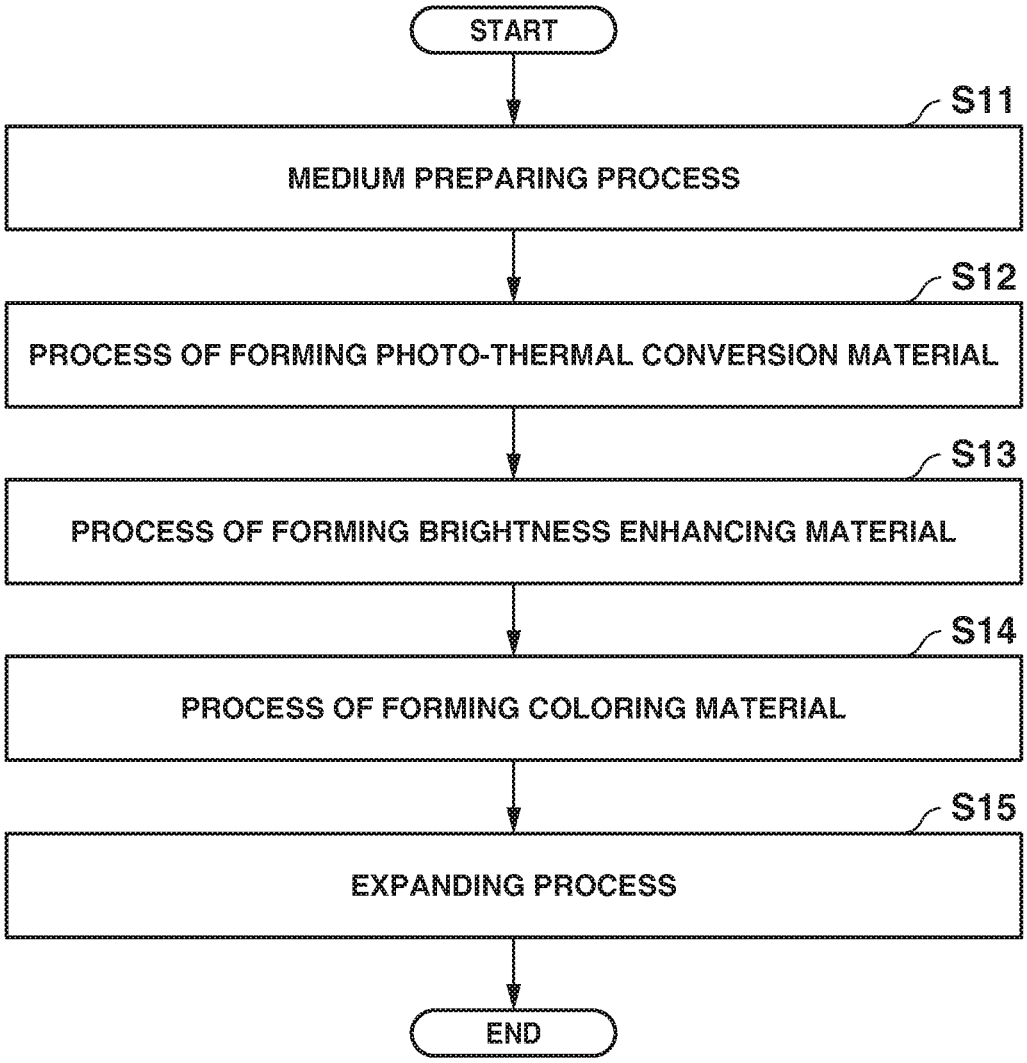
FIG. 2 is a flow chart of a method of forming a structure according to the embodiments of the invention.

FIG. 2 is a flow chart of a method of forming a structure according to the embodiments of the invention.

The processing medium M14 for forming a structure and a method of forming a structure according to the embodiments of the invention will be described with reference to FIG. 1A, FIG. 1B and FIG. 2 in detail.

[Processing Medium for Forming a Structure]

The processing medium M14 for forming a structure (hereinafter, simply referred to as the "processing medium") shown in FIG. 1A is manufactured from a medium M11, which is a laminated material consisting of a base material 101, a thermal expanding layer 102 and an ink absorbing layer 103, stacked in order on the top of the other. In the medium M11 shown in FIG. 1A, the thermal expanding layer 102 has not yet been heated to thermally expand.

The medium M11 with the thermal expanding layer 102 not thermally expanded has a flat surface. Even though a layer is formed on the surface by printing, the medium M11 keeps the flat surface (maintain flatness of the surface) as far as the thermal expanding layer 102 is not thermally expanded.

In the description of the embodiments of the invention, the medium having a flat surface means that the surface of the medium is flat or has little unevenness to a degree that allows printing by an offset printing system or to a degree that can reproduce the original tint of color of a printing matter by printing using a versatile printer of the ink-jet printing system and/or laser printing system, wherein the versatile printers of the ink-jet printing system and laser printing system are designed for the purpose of printing on a flat surface of printing media.

The base material 101 is made of a panel material such as paper, cloth (canvas) and plastic. The quality of the material 101 is not limited to a special one.

The thermal expanding layer 102 consists of thermoplastic resin or binder disposed on the base material 101. The binder contains forming agents of a heat-forming type (thermally expansive micro-capsules) which are distributed dispersively therein. The thermal expanding layer 102 absorbs heat (thermal energy) and expands in proportion to quantity of the absorbed thermal energy.

The ink absorbing layer 103 is formed for example in thickness of 10 μm so as to coat the whole upper surface of the thermal expanding layer 102. The ink absorbing layer 103 is made from a material appropriate for absorbing printing ink used in the ink-jet type printers, printing toner used in the laser-type printers, ink used in ball-point pens and fountain pens, and black lead of pencils to fix them thereon. A versatile ink absorbing layer of the printing paper used in the ink-jet type printer can be employed as the ink absorbing layer 103.

A thermal expanding layer whose surface is subjected to a proper process (for instance, a process for applying an ink absorbing layer all over the surface of the thermal expanding layer) so as to make the processed layer absorb ink can be used as the thermal expanding layer 102. When the thermal expanding layer subjected to the process is used as the thermal expanding layer 102, the ink absorbing layer 103 can be omitted from the processing medium M11.

Further, it will be possible to produce the binder of the thermal expanding layer 102 from an ink absorbing material. The ink absorbing layer 103 has at least an exposed portion without coated with a photo-thermal conversion material layer 104, a white material layer 105 and a coloring material layer 106. These layers will be described later. The exposed portion of the ink absorbing layer 103 allows to add a postscript such a message, drawing and picture thereon using ink or/and toner for printing and ink for other writing instruments.

When the ink absorbing layer 103, photo-thermal conversion material layer 104, white material layer 105 and coloring material layer 106 have elastic property, these layers will deform in accordance with expansion of the thermal expanding layer 102. As a result, the ink absorbing layer 103, photo-thermal conversion material layer 104, white material layer 105 and coloring material layer 106 are hard to generate a clearance between them.

If the clearance should be generated between them, it is likely that the clearance will reduce quantity of heat conduction from the photo-thermal conversion material layer 104 to the thermal expanding layer 102. Therefore, it is preferable that the ink absorbing layer 103, photo-thermal conversion material layer 104, white material layer 105 and coloring material layer 106 have comparatively higher elastic property.

[Method of Forming a Structure]

The method of forming a structure according to the embodiment of the invention will be described with reference to the flow chart of FIG. 2. At first, the medium M11 is prepared (step S11: a process of preparing a medium). Image data for forming a photo-thermal conversion material is previously prepared. Then, based on the prepared image data for forming a photo-thermal conversion material, black ink (black material containing carbon black as the photo-thermal conversion material having a photo-thermal conversion characteristic) is printed on areas of the ink absorbing layer 103 of the medium M11 by offset printing by an offset printing unit 200 (FIG. 5), wherein the areas correspond to portions of the thermal expanding layer 102 which are to be expanded, whereby the photo-thermal conversion material layer 104 is formed on the processing media M11 (step S12: a process of forming the photo-thermal conversion material).

The photo-thermal conversion material layer 104 is composed of a material which more easily converts optical energy to thermal energy than the base material 101, thermal expanding layer 102 and ink absorbing layer 103 of the medium M11. The image data for forming a photo-thermal conversion material sets a density of the black ink to be applied on the areas corresponding respectively to coordinates on a plane composing the image data. The image data for forming a photo-thermal conversion material can be generated based on the original colored two-dimensional image data by an arbitrary known technology. The offset printing unit 200 reads the density of the black ink set in the image data for forming a photo-thermal conversion material, and prints the black ink based on the read density of the black ink while controlling the density of the black ink for example by an area gradation technique. The medium M11 with the photo-thermal conversion material layer 104 formed thereon is called as a processing medium M12.

Since the thermal expanding layer 102 of the medium M11 is not expanded, a printing system such the offset printing system can be used, which is capable of printing at a higher speed than the ink-jet printing system and laser printing system. Therefore, a printing time can be more reduced by employing the offset printing system than the ink-jet printing system and laser printing system. Eventually, the offset printing system can reduce a time required for forming a structure while maintaining a high quality in printing. Particularly, when printing a large quantity of data, printing efficiency is enhanced by reducing the time required for printing. The printing system is not restricted to offset printing system, but as far as the printing system is capable of printing at a higher speed than the ink-jet printing system, such printing system can be employed. For example, a gravure printing system and silk screen printing system can be used.

If necessary, the ink-jet printing system and/or laser printing system can be employed for the printing operation. In this case, since the thermal expanding layer 102 of the medium M11 is not expanded, even if the versatile ink-jet printer and/or laser printer designed for the purpose of printing on a flat surface of a printing medium are employed, a structure showing an originally intended tint of color at high quality can be formed.

For example, these versatile printers include household printers and laser printers for use in an office.

When the printing surface of the medium M11 is not flat, the versatile ink-jet printer and/or general-purpose laser printer cannot print on such medium M11. Even if these printers can print on a lumpy surface of the medium M11, the printing quality will deteriorate, that is, it is hard to reproduce a shade of the originally intended colors on the surface of the medium M11 in comparison with the printing on the flat surface of the medium.

The image data for forming a photo-thermal conversion material can be produced based on data of the original image, for instance, the original colored two-dimensional image data by an arbitrary known method. The original image can be for instance an image which is imaged by a digital camera and/or a computer graphic image produced by an arbitrary method. The image data for forming a photo-thermal conversion material, image data for forming a brightness enhancing material, and image data for forming a coloring material are produced based on the data of the original image.

The image data for forming a photo-thermal conversion material indicates a forming density of a photo-thermal conversion material which is used when a structure is formed based on the original image, wherein the forming density of the material is a density of the material required to expand the material corresponding to the intended areas of the original image to an intended height level. The image data includes data representing the forming densities of the material at areas corresponding respectively to the coordinates on the plane composing the image data.

The image data for forming a brightness enhancing material indicates the forming density of the brightness enhancing material (white ink) required for enhancing visual brightness of the formed photo-thermal conversion material of the processing medium M12. The image data includes data representing the forming densities of the material at the areas corresponding respectively to the coordinates on the plane composing the image data.

The image data for forming a coloring material indicates the forming densities of coloring materials (not less than one color) required for coloring in intended colors the structure formed based on the original image, and includes data representing the forming densities of the coloring materials at the areas corresponding respectively to the coordinates on the plane composing the image data.

When optical energy is irradiated evenly over the surface of the photo-thermal conversion material layer 104 without replying on the position of the surface, the higher forming density of the photo-thermal conversion material is set at a portion of the surface of the photo-thermal conversion material layer 104, the more thermal energy (heat quantity) is generated at the portion.

Accordingly, more thermal energy will be conducted to the portion of the thermal expanding layer 102 corresponding to the portion of the photo-thermal conversion material layer 104 at which the forming density of the photo-thermal conversion material has been set higher than the other portion. Eventually, the portion of the thermal expanding layer 102 absorbs more thermal energy.

Further, the height to which a portion of the thermal expanding layer 102 expands has a positive correlation with the thermal energy absorbed by the portion. Therefore, when the optical energy is irradiated evenly over the surface of the photo-thermal conversion material layer 104 without replying on the position of the surface, the portion of the thermal expanding layer 102 corresponding to the portion of the photo-thermal conversion material layer 104 at which the forming density of the photo-thermal conversion material is set higher will expand to a higher level than the other portion of the of the thermal expanding layer 102.

Meanwhile, there is restriction on an expansion volume of the thermal expanding layer 102, and when the forming density of the photo-thermal conversion material of the photo-thermal conversion material layer 104 is even within the restriction, the larger the optical energy is irradiated on unit area of the photo-thermal conversion material layer 104 in unit time, the more the thermal expanding layer 102 receiving the optical energy expands.

Therefore, it is possible to properly change and set the forming density of the photo-thermal conversion material of the photo-thermal conversion material layer 104 and the thermal quantity of the optical energy irradiated on the photo-thermal conversion material layer 104 in consideration of mutual influence.

In the present embodiment of the invention, the photo-thermal conversion material layer 104 has the white material layer 105 and coloring material layer 106 formed at least on a portion of the layer 104, that is, the surface of the portion of the photo-thermal conversion material layer 104 is not exposed.

For instance, when light including infrared ray is irradiated as the optical energy on such portion of the photo-thermal conversion material layer 104, and when the white material layer 105 and coloring material layer 106 includes no carbon black (material has an photo-thermal conversion characteristic), the optical energy is not substantially absorbed by the white material layer 105 and coloring material layer 106 and passes through these layers.

Therefore, even if the white material layer 105 and coloring material layer 106 are formed on the photo-thermal conversion material layer 104, the thermal expanding layer 102 expands substantially to the same level as the thermal expanding layer 102 with the white material layer 105 and coloring material layer 106 not formed thereon, and the influences of the white material layer 105 and coloring material layer 106 formed on the photo-thermal conversion material layer 104 can be substantially ignored.

When a coloring material composing the coloring material layer 106 contains the carbon black (material has an photo-thermal conversion characteristic), the thermal energy photo-thermally converted in the coloring material layer 106 contributes to the expansion of the thermal expanding layer 102.

In this case, it is preferable to set the image data for forming the photo-thermal conversion material and image data for forming the coloring material such that the total quantity of the thermal energy photo-thermally converted in both photo-thermal conversion material layer 104 and coloring material layer 106 will be equivalent to the quantity of thermal energy that is required to expand the thermal expanding layer 102 to the intended height.

In other words, it is possible to set the forming density of the photo-thermal conversion material for forming the photo-thermal conversion material layer 104 to a value which is less than the forming density of the photo-thermal conversion material that contains the material having an photo-thermal conversion characteristic by a value corresponding to the quantity of heat conducted from the coloring material layer 106.

When the coloring material layer 106 does not contain the material having a photo-thermal conversion characteristic and includes only ink of three colors such as yellow "Y", mazenta "M" and cyan "C" ink, contribution of the heat absorbed by the coloring material layer 106 to the expansion of the thermal expanding layer 102 can be substantially ignored.

Figure 3:
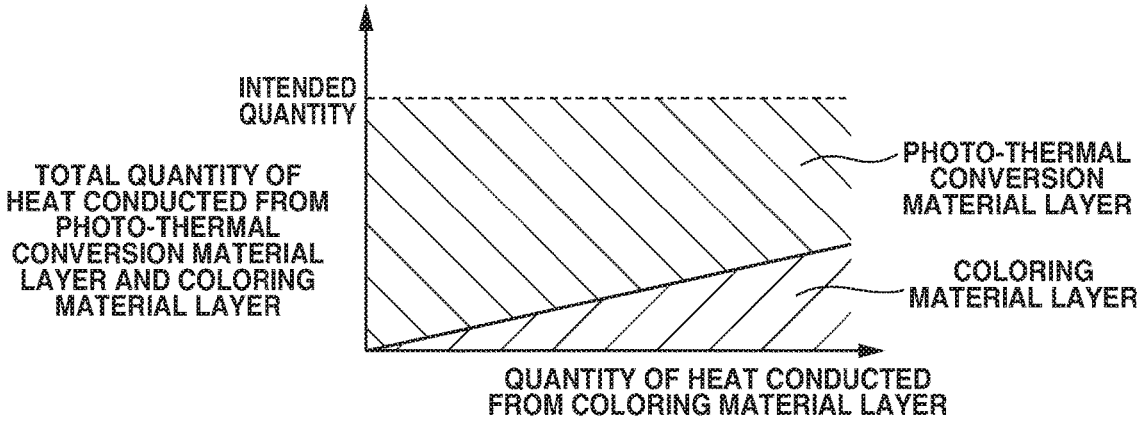
FIG. 3 is a view conceptionally showing a correlation between a quantity of heat conducted from a photo-thermal conversion material layer and a coloring material layer to a thermal expanding layer and a quantity of heat conducted from the coloring material layer to the thermal expanding layer.

FIG. 3 is a view conceptionally showing a correlation between the quantity of heat conducted from the photo-thermal conversion material layer 104 and the coloring material layer 106 to the thermal expanding layer 102 and the quantity of heat conducted from the coloring material layer 106 to the thermal expanding layer 102.

As shown in FIG. 3, in the range of a large quantity of heat conducted from the coloring material layer 106 to the thermal expanding layer 102, the forming density of the photo-thermal conversion material is set smaller such that the quantity of heat conducted from the photo-thermal conversion material layer 104 to the thermal expanding layer 102 will be smaller and the total quantity of heat conducted from the photo-thermal conversion material layer 104 to the thermal expanding layer 102 and heat conducted from the coloring material layer 106 to the thermal expanding layer 102 is set to an intended value.

When the heat conducted from a layer other than the photo-thermal conversion material layer 104 and coloring material layer 106 to the thermal expanding layer 102 contributes to the expansion of the thermal expanding layer 102, the forming density of the photo-thermal conversion material composing the photo-thermal conversion material layer 104 is set such that the total quantity of heat conducted from all the layers contributing to the expansion of the thermal expanding layer 102 will be the intended value.

In a processing medium M14 shown in FIG. 1A, only the photo-thermal conversion material layer 104 is formed on the topside of the base material 101, but it is possible to add the photo-thermal conversion material layer 104 on the back side of the base material 101. In the configuration of the base material 101 with the layers 104 formed on the both sides, when the quantity of heat conducted from the photo-thermal conversion material layer 104 formed on the top of the base material 101 is not enough to make the thermal expanding layer 102 expand to the intended level, the heat conducted from the photo-thermal conversion material layer 104 formed on the back side of the base material 101 can compensate for the heat in short.

Based on the previously prepared image data for forming a brightness enhancing material, the white ink is printed as the brightness enhancing material by means of offset printing so as to coat at least a portion of the photo-thermal conversion material formed on the processing medium M12 by the offset printing unit 200 (FIG. 5), thereby forming the brightness enhancing material layer 105 on the processing medium M12 (step S13: a process of forming the brightness enhancing material in FIG. 2).

Hereinafter, the medium M12 with the brightness enhancing material layer 105 formed thereon will be referred to as the processing medium M13.

In the process S13 of forming the brightness enhancing material, the white ink is used. Therefore, when a portion of the medium M11 on which the black ink is printed, is subjected to the process S13, the portion will be enhanced in visual brightness. When color ink in place of the white ink is applied on the black ink printed on the medium M11, the tint of the color ink applied on the medium M11 will fade and the color development will be insufficient.

But when the white ink is formed on the black ink, and further color ink is applied on the white ink, the color development of the color ink will be more improved, enhancing the quality of the formed structure than the case where no white ink is formed on the black ink.

Further, as shown in FIG. 1A, the white ink is formed so as to cover the whole forming area of the black ink, enhancing the brightness of the whole forming area where the black ink is formed. The forming area where the white ink is formed is not always necessarily equivalent to the forming area where the black ink is formed, and the white ink will preferably cover at least a part of the forming area where the black ink is formed. Therefore, a part of the forming area where the white ink is formed may cover the area where the black ink is not formed.

Since the thermal expanding layer 102 of the processing medium M12 has not yet been expanded, it is possible in the process S13 of forming the brightness enhancing material in the same way as the process S12 of forming the photo-thermal conversion material to select a printing system such as the offset printing system which is capable of printing at a relatively high speed. Further, in the process S13 for forming the brightness enhancing material in the same way as the process S12 for forming the photo-thermal conversion material, the offset printing system can more reduce a printing time and also a time required for forming a structure than the ink-jet printing system and laser printing system, while maintaining a high quality of printing. If necessary, it is possible to use only the printer of the versatile ink-jet printing system and/or laser printing system to perform the printing operation. In this case, the same effect can be obtained as the process S12 for forming the photo-thermal conversion material.

In the image data for forming the brightness enhancing material, it is possible to set a value of "0" at the coordinates of the portion of the processing medium M12 on which no photo-thermal conversion material layer 104 is formed, and also to set a value other than "0" at the coordinates of the other portion of the processing medium M12 on which the photo-thermal conversion material layer 104 is formed.

Using these values set at the coordinates it will be possible to form the brightness enhancing material layer 105 only on the portion of the medium M11 whose visual brightness is reduced by forming the photo-thermal conversion material thereon, whereby the brightness of such portion of the medium M11 will be enhanced. Therefore, the consumed quantity of white ink will be decreased to the minimum, while enhancing the brightness enhancing effect.

In the image data for forming the brightness enhancing material, it is possible to set a value evenly to the portion of the processing medium M12 on which the photo-thermal conversion material layer 104 is formed. On the other hand, in the image data it is possible to set the larger forming density of white ink to the portion where the brightness enhancing material of the larger forming density is formed. Since the forming densities of the white ink are set in the above manner, the lower the visual brightness of the portion of the processing medium M12 is, the more the visual brightness of the portion will be enhanced. Therefore, the medium M13 with the brightness enhancing material formed thereon is enhanced in visual brightness, and the visual brightness will be made even on the whole surface of the medium M13 regardless of the portion.

Further, in the image data for forming the brightness enhancing material, it is possible to set a value evenly to the whole surface of the processing medium M12. In this case, it is possible to enhance the brightness of at least the portion of the processing medium M12 on which the photo-thermal conversion material layer 104 is formed. When the surface of the medium M11 is not pure white but white to somewhat fade out, the portion of the processing medium M12 on which no photo-thermal conversion material layer 104 is formed will be enhanced in brightness.

In the above process S13 of forming the brightness enhancing material, it has been explained as an example that the white ink is used to form the brightness enhancing material layer 105. But in the above process S13 of forming the brightness enhancing material, it is possible to print at least one of three inks of colors such as yellow "Y", mazenta "M" and cyan "C". In this case where such ink is applied on the black ink printed on the medium M11, the medium M11 will be enhanced in visual brightness, wherein the ink of at least one color functions as the brightness enhancing material.

Then, based on the previously prepared image data for forming a coloring material, the inks of colors such as yellow "Y", mazenta "M" and cyan "C" are offset-printed as the coloring material on a processing medium M13 by the offset printing unit 200 (FIG. 5), whereby the coloring material layer 106 is formed on the processing medium M13 (step S14: a process of forming the coloring material in FIG. 2).

Hereinafter, the processing medium M13 with the coloring material layer 106 formed thereon is referred to as the processing medium M14.

In the process S14 for forming the coloring material, since three color inks are used, the whole surface of the processing medium M14 subjected to the process S14 will be colored with the intended visual tint of color.

In the present embodiment of the invention, as shown in FIG. 1B, at least one color ink out of three color inks is formed on at least one portion of plural portions of the photo-thermal conversion material layer 104 with black ink formed thereon and plural portions of the brightness enhancing material layer 105 with white ink formed thereon, such that all the black-ink formed areas, all the white-ink formed areas, all the boundary areas of the black-ink formed area, and all the boundary areas of the white-ink formed area will be coated with the one color ink.

Further, although not shown in FIG. 1B, at least one color ink out of three color inks is formed on all of the plural portions of the photo-thermal conversion material layer 104 with black ink formed thereon and all of the plural portions of the brightness enhancing material layer 105 with white ink formed thereon, such that all the black-ink formed areas, all the white-ink formed areas, all the boundary areas of the black-ink formed area, and all the boundary areas of the white-ink formed area are covered with the one color ink.

Since the thermal expanding layer 102 of the processing medium M13 has not yet been expanded, it is possible in the process S14 for forming the brightness enhancing material substantially in the same way as in the process S12 of forming the photo-thermal conversion material and the process S13 of forming the brightness enhancing material to select the printing system such the offset printing system which is capable of printing at a relatively high speed.

Further, in the process S14 for forming the brightness enhancing material substantially in the same way as in the process S12 of forming the photo-thermal conversion material and the process S13 of forming the brightness enhancing material, the offset printing system can more reduce the printing time and also the time required for forming a structure than the ink-jet printing system and laser printing system, while maintaining a high quality of printing.

If necessary, it is possible to use only the printer of the versatile ink-jet printing system and/or laser printing system to perform the printing operation. In this case, the same effect can be obtained as the effect obtained in the process S12 of forming the photo-thermal conversion material and the process S13 of forming the brightness enhancing material.

In the image data for forming a coloring material, it is possible to set a value other than "0" for at least one color to be applied on the whole surface of the processing medium M12 such that the whole surface of the processing medium M13 will be colored. Meanwhile, it is possible to set a value of "0" to values of the image data of a portion of the surface of the processing medium M12 such that at least such portion of the processing medium M12 will not be colored, that is, it is possible to set a value of "0" to the color-ink forming densities of all the color inks.

In the present embodiment, when the photo-thermal conversion material layer 104, brightness enhancing material layer 105 and coloring material layer 106 are formed on the ink absorbing layer 103, it is possible to leave at least one portion of the ink absorbing layer 103, which portion none of the photo-thermal conversion material layer 104, brightness enhancing material layer 105 and coloring material layer 106 are formed on and is exposed.

In all the image data for forming a photo-thermal conversion material, image data for forming a white material, and image data for forming a coloring material, a value of "0" is set to the forming density of a portion of the ink absorbing layer 103, whereby such portion is left exposed on the ink absorbing layer 103.

As the thermal expanding layer 102 expands to enlarge its surface area in a process S15 (to be described later) for expanding the thermal expanding layer 102, the density of the formed coloring material layer 106 will be reduced. As a result, the structure M15 formed by expanding the processing medium M14 will be more faded visually in tint of color than the processing medium M14 which has not yet been subjected to the expanding process S15.

Therefore, the image data for forming a coloring material will be set to a value such that the processing medium M14 subjected to the expanding process S15 will be colored so as to show visually the intended tint of color.

In other words, it is possible to set the image data for forming a coloring material to a value such that the processing medium M14 applied with at least one color ink will be colored more deeply in tint of color than the intended visual tint of color before subjected to the expanding process S15.

When a portion of the processing medium M14 and the other portion will be made equivalent visually in tint of color before subjected to the expanding process S15 and the portion of the processing medium M14 is made more expanded than the other portion, the image data for forming a coloring material of the portion of the processing medium M14, that is, the forming density of the portion of the processing medium M14 is set to a value larger than a value set to the image data of the other portion.

Figure 8A:
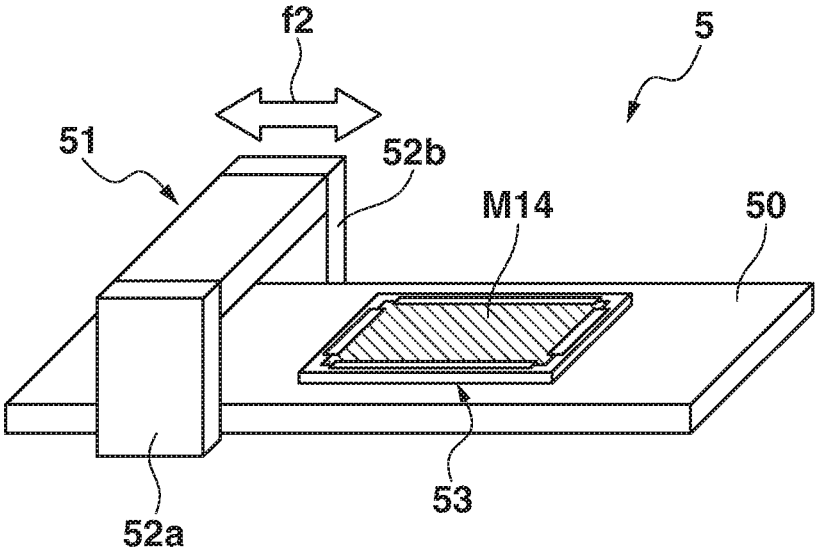
FIG. 8A is a perspective view showing a configuration of a heating unit.
Figure 8B:
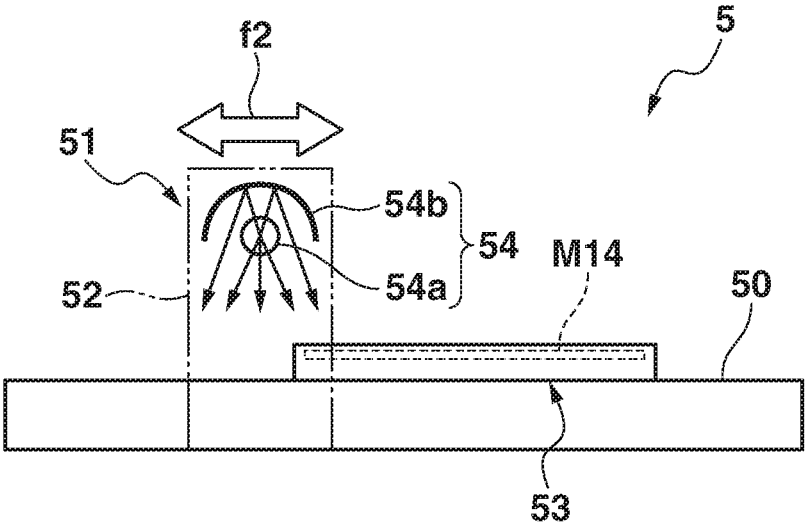
FIG. 8B is a side view showing the configuration of the heating unit.

Then, the processing medium M14 is carried to a heating unit 5 (FIGS. 4, 5, 8A and 8B). The heating unit 5 comprises a light source unit 54 having a light source 54*a* such as a halogen lamp, as shown in FIG. 8B. The light source 54*a* emits light (infrared rays, light energy) toward the processing medium M14 carried into the heating unit 5. The light energy emitted toward the processing medium M14 is converted into thermal energy in the photo-thermal conversion material layer 104. The thermal energy is conducted to the thermal expanding layer 102. Then the thermal expanding layer 102 is heated with the thermal energy and expands (step S15: a process of expanding a layer). When the processing medium M14 is subjected to the process S15, the thermal expanding layer 102 of the processing medium M14 will expand, whereby a structure will be obtained as shown in FIG. 1B. The expansion volume of the thermal expanding layer 102 varies in accordance with the forming density of the photo-thermal conversion material of the photo-thermal conversion material layer 104 and a quantity of the light energy emitted thereto.

In the portion of the thermal expanding layer 102 on which the photo-thermal conversion material layer 104 is not formed, the light energy is hardly converted into the thermal energy. Therefore, the portion of the thermal expanding layer 102 is not substantially expanded, or the expansion volume of the thermal expanding layer 102 is smaller enough to be ignored than the other portion.

In the present embodiment of the invention, as shown in FIG. 1A, ink of at least one color is formed to cover all the black-ink formed areas, all the white-ink formed areas, all the boundary areas of the black-ink formed areas, and all the boundary areas of the white-ink formed areas.

On the portions with the color ink formed thereon, the surface and sides of the photo-thermal conversion material layer 104 with black ink formed thereon, and the surface and sides of the brightness enhancing material layer 105 with white ink formed thereon are covered with the coloring material layer 106. Accordingly, since the black ink and white ink are covered with the color ink and cannot be seen, the processing medium M14 is formed, which shows the substantially intended tint of color or with the intended tint of color.

[Structure Forming Apparatus]

Figure 4:
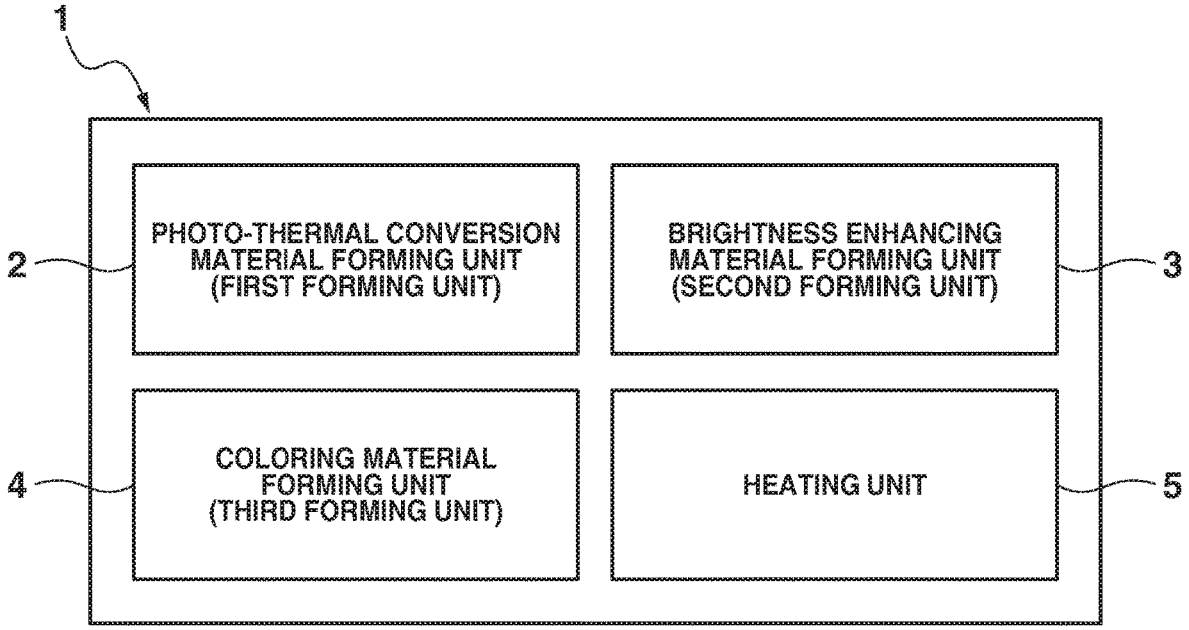
FIG. 4 is a block diagram showing a configuration of a structure forming apparatus according to the embodiments of the invention.

FIG. 4 is a block diagram showing a configuration of a structure forming apparatus according to the embodiments of the invention.

As shown in FIG. 4, the structure forming apparatus 1 comprises a photo-thermal conversion material forming unit (first forming unit) 2 for forming a photo-thermal conversion material, a brightness enhancing material forming unit (second forming unit) 3 for forming a brightness enhancing material, a coloring material forming unit (third forming unit) 4 for forming a coloring material, and the heating unit 5 having the light source 54*a* which emits light energy toward the processing medium 14.

Figure 5:
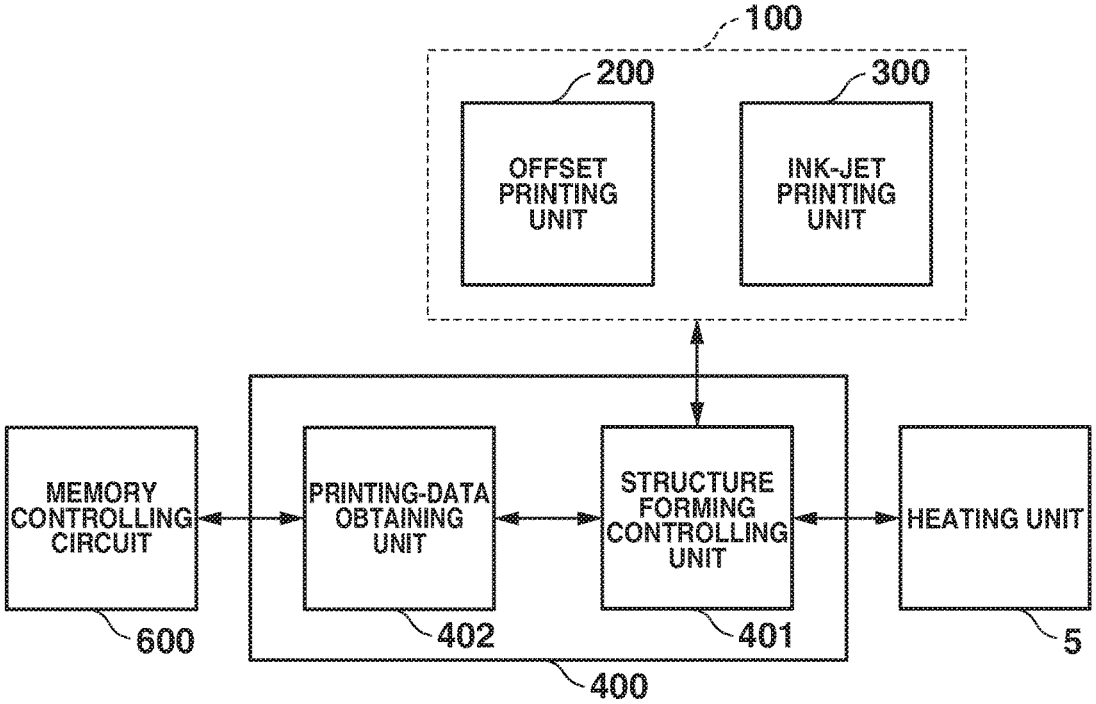
FIG. 5 is a block diagram showing a configuration of a controlling unit of the structure forming apparatus according to the embodiments of the invention.

FIG. 5 is a block diagram mainly showing a controlling unit of the structure forming apparatus according to the embodiments of the invention.

The controlling unit 400 of the structure forming apparatus 1 controls operation of the heating unit 5 and a printing unit 100 including the offset printing unit 200 and/or ink-jet printing unit 300, and cooperates with the heating unit 5 and printing unit 100 to function as a structure forming controlling unit 401 for forming a structure.

The controlling unit 400 of the structure forming apparatus 1 controls a printing-data obtaining unit 402 to obtain printing data and printing controlling data from a memory controlling circuit 600. The controlling unit 400 functions as the structure forming controlling unit 401 for controlling forming a structure based on the obtained data.

Figure 6:
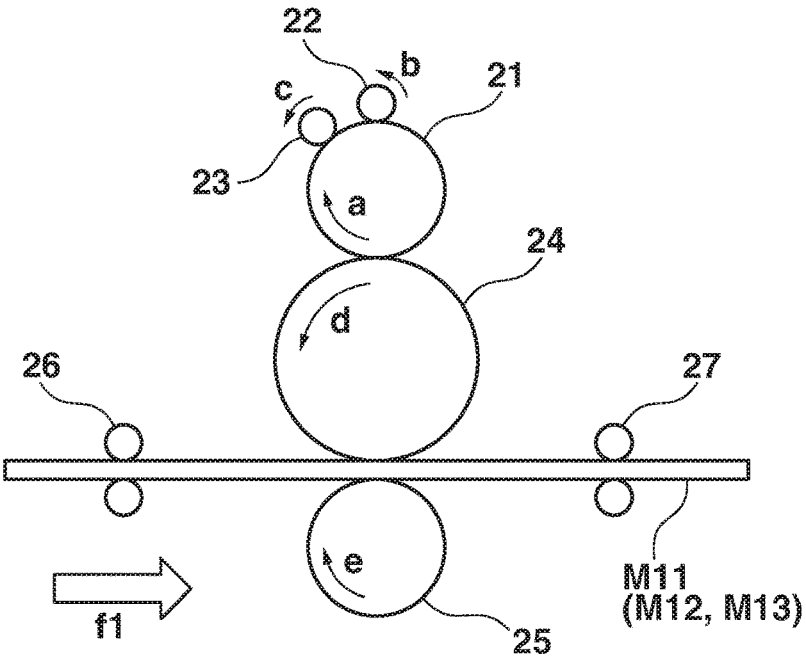
FIG. 6 is a cross-sectional view briefly showing a configuration of the offset printing unit.

FIG. 6 is a cross-sectional view briefly showing a configuration of the offset printing unit 200 which is used as either one of the photo-thermal conversion material forming unit 2, brightness enhancing material forming unit 3 and coloring material forming unit 4.

Figure 7:
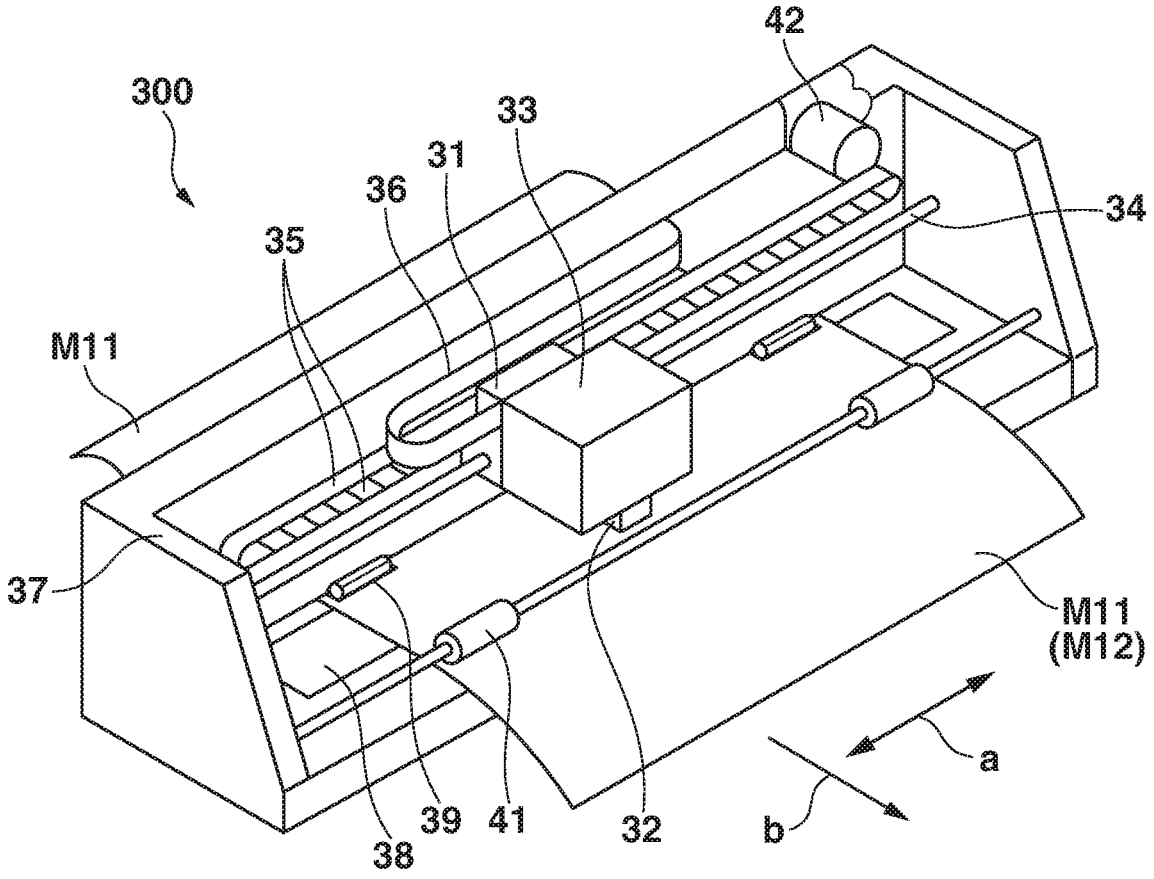
FIG. 7 is a perspective view showing a configuration of the ink-jet printing unit used in the embodiments of the invention.

FIG. 7 is a perspective view showing a configuration of the ink-jet printing unit 300 (printer of a general-purpose ink-jet printing system) which is used for either one of the photo-thermal conversion material forming unit (first forming unit) 2, brightness enhancing material forming unit (second forming unit) 3 and coloring material forming unit (third forming unit) 4, for which the offset printing unit 200 is not used.

The structure forming apparatus 1 according to the present embodiment will be explained as an example, in which the offset printing unit 200 is used as the photo-thermal conversion material forming unit (first forming unit) 2, and the ink-jet printing unit 300 is used as the brightness enhancing material forming unit (second forming unit) 3 and coloring material forming unit (third forming unit) 4. The offset printing unit 200 is required to function as at least either one of the photo-thermal conversion material forming unit (first forming unit) 2, brightness enhancing material forming unit (second forming unit) 3 and coloring material forming unit (third forming unit) 4. Therefore, it is allowed to use the offset printing unit 200 for all of the photo-thermal conversion material forming unit (first forming unit) 2, brightness enhancing material forming unit (second forming unit) 3 and coloring material forming unit (third forming unit) 4.

In this case, the structure forming apparatus 1 according to the present embodiment needs no ink-jet printing unit 300. On the contrary, it is possible to use the ink-jet printing unit 300 for all of the photo-thermal conversion material forming unit (first forming unit) 2, brightness enhancing material forming unit (second forming unit) 3 and coloring material forming unit (third forming unit) 4. In this case, the structure forming apparatus 1 needs no offset printing unit 200.

A general configuration of the offset printing unit 200 will be described with reference to FIG. 6. In the present embodiment of the invention, the offset printing unit 200 is not required to have a configuration specified for the present embodiment, and a versatile offset printer can be used as the offset printing unit 200. The offset printing unit 200 comprises a plate cylinder 21, ink roller 22, water roller 23, blanket cylinder 24, impression cylinder 25, paper feeding roller pair 26, and paper ejecting roller pair 27.

In FIG. 6, arrows "a" to "e" indicate rotation directions of the plate cylinder 21, ink roller 22, water roller 23, blanket cylinder 24 and impression cylinder 25, respectively. An outlined white arrow "f1" indicates a direction in which the medium M11 is transferred. The controlling unit 400 of the structure forming apparatus 1 controls operation of the plate cylinder 21, ink roller 22, water roller 23, blanket cylinder 24, impression cylinder 25, paper feeding roller pair 26, and paper ejecting roller pair 27 of offset printing unit 200, thereby controlling a printing operation as follows.

The controlling unit 400 of the structure forming apparatus 1 controls operation of the printing-data obtaining unit 402 to obtain printing data and printing controlling data from the memory controlling circuit 600, and previously forms an original plate based on the obtained printing data and printing controlling data.

Then the formed original plate is wrapped around the plate cylinder 21. The plate cylinder 21 with the original plate wrapped around turns to contact with the water roller 23. Then a portion of the peripheral surface of the plate cylinder 21 corresponding to the portion of the medium M11 on which no printing has been performed will get wet with water.

The plate cylinder 21 further turns to contact with the ink roller 22. Then the other portion of the peripheral surface of the plate cylinder 21 corresponding to the other portion of the medium M11 on which printing has been effected (the other portion of the peripheral surface of the plate cylinder 21 which has not gotten wet) is adhered with the photo-thermal conversion material. The plate cylinder 21 further turns to make the portion of the plate cylinder 21 with the photo-thermal conversion material adhered thereon contact with the blanket cylinder 24, whereby the photo-thermal conversion material adhered to the plate cylinder 21 is transferred onto the blanket cylinder 24 (intermediate transfer body).

Meanwhile, the paper feeding roller pair 26 holds the medium M11 between the two rollers and transfers the medium M11 in the direction indicated by the outlined white arrow "f1" shown in FIG. 6. The medium M11 is transferred through between the blanket cylinder 24 and impression cylinder 25 by the paper feeding roller pair 26. The paper ejecting roller pair 27 holds the medium M11 transferred from between the blanket cylinder 24 and impression cylinder 25 and further transfers the medium M11 in the direction indicated by the outlined white arrow "f1".

As described above, the controlling unit 400 of the structure forming apparatus 1 controls operation of the offset printing unit 200, whereby the photo-thermal conversion material transferred on the blanket cylinder 24 is further transferred onto a proper position of the surface of the medium M11 while the medium M11 is being sent through between the blanket cylinder 24 and impression cylinder 25.

With reference to FIG. 7 a general configuration of the ink-jet printing unit 300 will be described. In the present embodiment of the invention, the ink-jet printing unit 300 is not required to have a configuration specified for the structure forming apparatus 1, and the versatile ink-jet printer can be used as the ink-jet printing unit 300 of the structure forming apparatus 1. The ink-jet printing unit 300 is provided with a carriage 31 which moves reciprocally in the direction (main scanning direction) indicated by an arrow "a" perpendicular to the direction (sub-scanning direction) in which paper is transferred. The carriage 31 is provided with a cartridge 33 containing ink and a printing head 32 for printing on the medium M11 using the ink contained in the cartridge 33.

The cartridge 33 contains ink of substantially the same color as the visual tint of color of the material that is formed by the unit, for which the offset printing unit 200 is not used, among the photo-thermal conversion material forming unit 2, brightness enhancing material forming unit 3 and coloring material forming unit 4.

In the present embodiment the offset printing unit 200 is used as the photo-thermal conversion material forming unit 2. Therefore, when the ink-jet printing unit 300 is used as the brightness enhancing material forming unit 3, white ink is contained in the cartridge 33 of the ink-jet printing unit 300.

Further, when the ink-jet printing unit 300 is used as the coloring material forming unit 4, inks of cyan, mazenta and yellow colors are separately contained in the cartridge 33 of the ink-jet printing unit 300. Ink containers of the cartridge 33 are connected to the corresponding printing heads 32, respectively.

The carriage 31 has a through hole and is slidably supported by a guide rail 34 penetrating through the through hole.

The carriage 31 is provided with a holding part and a driving belt 35 holds this holding part to carry the carriage 31 together with the printing heads 32 and cartridge 33 in the main scanning direction.

The controlling unit 400 of the structure forming apparatus 1 is connected with the printing heads 32 through the flexible communication cable 36. The structure forming controlling unit 401 sends the printing data and printing controlling data to the printing heads 32 through the flexible communication cable 36. The printing heads 32 are controlled based on the printing data and printing controlling data.

A platen 38 is provided at the lower part of an inner frame 37 so as to face the printing heads 32 and extends out in the main scanning direction indicated by the arrow "a". The platen 38 is one of the elements composing a paper transferring pass.

The processing medium M12 and processing medium M13 are intermittently transferred on the platen 38 in the sub-scanning direction by paper feeding roller pairs 39 (the lower rollers are not shown) and paper ejecting roller pair (the lower roller is not shown) 41. The paper feeding roller pairs 39 and paper ejecting roller pairs 41 are driven by the controlling unit 400 of the structure forming apparatus 1.

The controlling unit 400 of the structure forming apparatus 1 controls operation of a motor 42, the printing heads 32, paper feeding roller pairs 39 and paper ejecting roller pairs 41 to drive the driving belt 35 connected to the motor 42, thereby carrying the printing heads 32 together with the carriage 31 to a proper position in the main scanning direction and making the printing heads 32 inject ink toward the processing medium M12 and processing medium M13 during a conveyance stopping period of the media M12, M13.

When the ink is injected onto the processing medium M12 and processing medium M13, the brightness enhancing material layer 105 and coloring material layer 106 are formed on the whole surface of the media M12, M13 and the media M12, M13 are processed to the processing media M13, M14, respectively.

When the ink-jet printing unit 300 is used for both the brightness enhancing material forming unit 3 and coloring material forming unit 4, the cartridge 33 contains white ink, cyan ink, mazenta ink and yellow ink separately.

The controlling unit 400 of the structure forming apparatus 1 controls the carriage 31 to make the printing heads 32 print the white ink on the processing medium M12 and processing medium M13, while moving the printing heads 32 in the main scanning direction (first direction), and further to make the printing heads 32 print the cyan ink, mazenta ink and yellow ink on the media M12, M13, while moving the printing heads 32 in the main scanning direction (opposite to the first direction).

A time that the ink-jet printing unit 300 needs to perform the printing process as described above can be more reduced than a printing process in which the white ink is printed on the whole surface of the media M12, M13 and thereafter the cyan ink, mazenta ink and yellow ink are printed on the media M12, M13.

In the above description of the embodiments, the ink-jet printing unit 300 has been described, which is used as either one of the photo-thermal conversion material forming unit 2, brightness enhancing material forming unit 3, and coloring material forming unit 4 for which the offset printing unit 200 is not used. Yet, it is not necessarily necessary to use the ink-jet printing unit 300, but a printer of another known printing system such as the laser printer can be used as the units 2, 3 and 4, for which the offset printing unit 200 is not used.

FIG. 8A is a perspective view showing a configuration of the heating unit 5. FIG. 8B is a side view showing the configuration of the heating unit 5.

As shown in FIG. 8A, the processing medium M14 is placed on a medium supporting frame 53 fixed onto a mounting plate 50 of the heating unit 5, and then conveyed into the heating unit 5.

The heating unit 5 has a heat source unit 51 that can move along two sides facing each other of the rectangle mounting plate 50. The heat source unit 51 is supported at its both sides by supporting walls 52*a*, 52*b*. The controlling unit 400 of the structure forming apparatus 1 moves the supporting walls 52*a*, 52*b* along the both sides of the rectangle mounting plate 50 in the direction indicated by an outlined white arrow "f2" in FIG. 8A, thereby moving the heat source unit 51 relatively to the processing medium M14 fixedly placed on the mounting plate 50.

While the heat source unit 51 is moving relatively to the processing medium M14, the controlling unit 400 of the structure forming apparatus 1 controls the light source 54*a* of the light source unit 54 of the heat unit 51 and makes the light source unit 54 emit optical energy toward the processing medium M14. As shown in FIG. 8B, the light source unit 54 has a reflecting mirror 54*b*, which effectively reflects the optical energy of the light source 54*a* toward the processing medium M14.

As described above, the more the optical energy is emitted toward a unit area of the photo-thermal conversion material layer 104 in unit time, the more the thermal expanding layer 102 will expand. The controlling unit 400 of the structure forming apparatus 1 moves the supporting walls 52*a*, 52*b* and controls the light source 54*a* such that the heat unit 51 will move at a constant speed relatively to the processing medium M14 and the light source 54*a* will emit constant optical energy toward the processing medium M14.

As far as the optical energy emitted toward a unit area of the photo-thermal conversion material layer 104 of the thermal expanding layer 102 in unit time will be even on all over the surface of the processing medium M14, the controlling method to be performed by the controlling unit 400 of the structure forming apparatus 1 is not restricted to the above described method.

For instance, a halogen lamp of 900 W is used as the light source 54*a*, and is disposed 4 cm apart from the processing medium M14. The relative moving speed of the light source unit 54 to the processing medium M14 is set to about 20 mm/sec. Under these conditions, the processing medium M14 is heated to a temperature of 100 to 110 degrees Centigrade, whereby the thermal expanding layer 102 with the photo-thermal conversion material layer 104 formed thereon will be expanded in the processing medium M14

In the embodiment described above, the photo-thermal conversion material layer 104 is printed or formed on the medium M11 having the thermal expanding layer 102, before said thermal expanding layer 102 is expanded. Further, at least either one of the brightness enhancing material layer 105 and coloring material layer 106 is printed or formed on the photo-thermal conversion material layer 104, before the thermal expanding layer 102 is expanded. Then the thermal expanding layer 102 of the medium M11 is heated for expansion, whereby the structure M15 is formed. That is, at least either one of the brightness enhancing material layer 105 and coloring material layer 106 is formed on the photo-thermal conversion material layer 104 of the medium M11, whereby the structure M15 is formed. In the process of forming the structure M15, either one of the photo-thermal conversion material layer 104, brightness enhancing material layer 105 and coloring material layer 106 is printed on the thermal expanding layer 102 before said thermal expanding layer 102 is expanded. Therefore, these layers 104, 105 and 106 can be formed by the offset printing system, and a time required to form the structure M15 can be reduced while maintaining a high quality of printing. Even though the versatile ink-jet printer and/or general-purpose laser printer, which are designed for the purpose of printing on the printing medium having a flat surface, are used to form the photo-thermal conversion material layer 104, brightness enhancing material layer 105 and coloring material layer 106, the structure M15 can be formed, which reproduces the intended tint of color at a high quality.

The structure forming apparatus 1 according to the present embodiment has been described as an example in the above description, in which apparatus the light source unit 54 is moved at a relative speed to the processing medium M14 to heat the whole processing medium M14 evenly, while said processing medium M14 is held at one position. Yet, the heating process is not limited to the above described. On the contrary, it is possible to heat the whole processing medium M14 evenly by moving the light source unit 54 according to the need while said processing medium M14 is being moved relatively to the light source unit 54.

Modified Embodiment of the Invention

The modified embodiment of the invention will be described with reference to FIG. 9A and FIG. 9B.

Figure 9A:
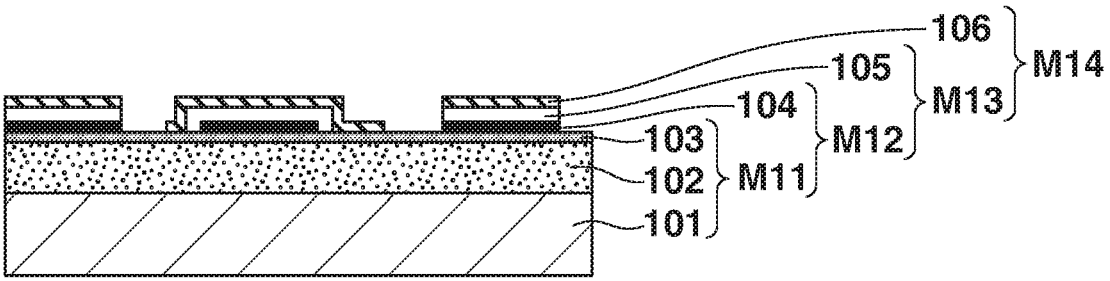
FIG. 9A is a cross-sectional view showing a processing medium for forming a structure according to the modified embodiment of the invention.
Figure 9B:
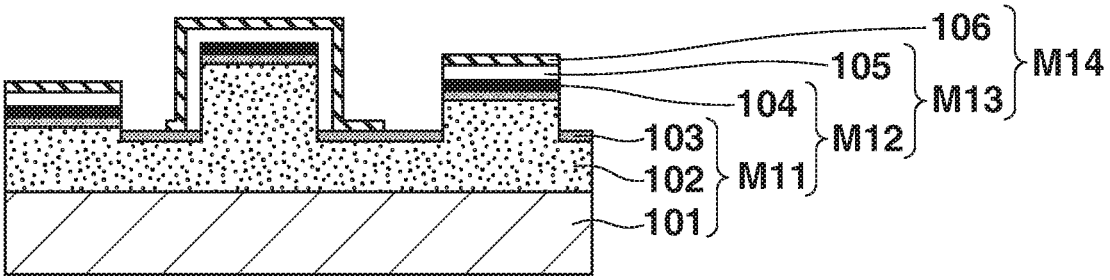
FIG. 9B is a cross-sectional view showing the expanded processing medium for forming a structure according to the modified embodiment of the invention.

FIG. 9A is a cross-sectional view showing a processing medium for forming a structure according to the modified embodiment of the invention. FIG. 9B is a cross-sectional view showing the expanded processing medium for forming a structure according to the modified embodiment of the invention. In FIG. 9A and FIG. 9B, the description of like elements and contents as those in FIG. 1A and FIG. 1B will be omitted.

As shown in FIG. 9A, in the present modified embodiment, the white ink and at least one of the three color inks are applied or formed so as to cover all over the black ink formed area and the boundary area of the black ink formed area on one of plural portions of the photo-thermal conversion material layer 104 with the black ink applied. Although not shown in FIG. 9A, it is possible to apply or form the white ink and at least one of the three color inks on all the plural portions of the photo-thermal conversion material layer 104 with the black ink applied so as to coat all over the black ink formed areas and the boundary areas of the black ink formed areas.

In the present modified embodiment, the white ink and at least one of the three color inks are applied so as to cover all over the black ink formed areas and the boundary areas of the black ink formed areas, as shown in FIG. 9A. In the portions of the photo-thermal conversion material layer 104 with the color ink applied or formed thereon, the black ink applied on the surfaces and sides of said portions is coated with the white material layer 105 and coloring material layer 106, after the thermal expanding layer 102 is expanded, as shown in FIG. 9B.

Therefore, the black ink is covered with the white ink and color ink, and cannot be seen from outside, and the processing medium M14 can be formed or produced, which shows substantially the intended tint of color.

In the present modified embodiment, since all the surfaces and sides of the photo-thermal conversion material layer 104 applied with the black ink are covered with two layers (white material layer 105 and coloring material layer 106), the processing medium M14 will be formed, having the tint of color more close to the intended tint of color than the photo-thermal conversion material layer 104 coated with a single layer (coloring material layer 106).

Although specific embodiments of the invention have been described in the foregoing detailed description, it will be understood that the invention is not limited to the particular embodiments described herein, but modifications and rearrangements may be made to the disclosed embodiments while remaining within the scope of the invention as defined by the following claims. It is intended to include all such modifications and rearrangements in the following claims and their equivalents.

What is claimed is:

1. A structure forming apparatus comprising:

a printer configured to print a photo-thermal conversion material, a white material, and a coloring material in order on an expanding layer in an overlapping manner, the expanding layer being expandable by being heated with thermal energy of light;

a heater configured to irradiate light on the expanding layer from a side of the coloring material to expand the expanding layer; and a controller configured to set, when the coloring material has a photo-thermal characteristic, a printing density of the photo-thermal conversion material to be printed to be lower by an amount corresponding to a quantity of heat conducted from the coloring material than the printing density of the photo-thermal conversion material to be printed when the coloring material has no photo-thermal conversion characteristic, and to control printing of the photo-thermal conversion material at the set printing density.

2. The structure forming apparatus according to claim 1, wherein the printer is configured to print the photo-thermal conversion material at a printing density that is required to expand the expanding layer to a predetermined height, and to print the coloring material at a printing density that is required to express a predetermined shade.

3. The structure forming apparatus according to claim 2, wherein the controller is configured to:

set the printing density of the photo-thermal conversion material and the printing density of the coloring material such that a total amount of heat conducted to the coloring material and the photo-thermal conversion material by the irradiated light is equivalent to an amount of heat that is required to expand the expanding layer to the predetermined height; and control the printer to print the photo-thermal conversion material at the set printing density and the coloring material at the set printing density.

4. The structure forming apparatus according to claim 3, wherein the controller is configured such that, in a range in which an amount of heat conducted from the coloring material to the expanding layer is larger than an amount of heat conducted from the photo-thermal conversion material to the expanding layer, the controller sets the printing density of the photo-thermal conversion material lower such that the amount of heat conducted from the photo-thermal conversion material to the expanding layer is reduced.

5. The structure forming apparatus according to claim 3, wherein the controller is configured such that, when heat conducted from a material other than the photo-thermal conversion material and the coloring material contributes to expanding the expanding layer, the controller sets the printing density of the photo-thermal conversion material such that an amount of heat conducted from the materials contributing to expanding the expanding layer will be equivalent to the amount of heat that is required to expand the expanding layer to the predetermined height, and controls the printer to print the photo-thermal conversion material at the set printing density.

6. The structure forming apparatus according to claim 1, wherein the controller is configured to estimate a surface area of the expanding layer after expansion thereof, adjust the printing density of the coloring material based on the estimated surface area of the expanding layer, and control the printer to print the coloring material at the adjusted printing density, before the expanding layer is expanded by the heater.

7. The structure forming apparatus according to claim 6, wherein, in a medium consisting of the photo-thermal conversion material, the white material, and the coloring material printed in order on the expanding layer in the overlapping manner, when a first portion of the medium has expanded to be larger than a second portion of the medium, the controller is configured to:

adjust the printing density of the coloring material such that the coloring material will show substantially the same coloring expression on the first portion of the medium and the second portion of the medium after the medium is expanded; and control the printer to print the coloring material at the adjusted printing density.

8. The structure forming apparatus according to claim 7, wherein the controller is configured such that, when the first portion of the medium has expanded to be larger than the second portion of the medium and the coloring material shows substantially the same coloring expression on the first portion of the medium and the second portion of the medium after the medium is expanded, the controller sets the printing density of the coloring material to be printed on the first portion of the medium to be higher than the printing density of the coloring material to be printed on the second portion of the medium.

9. The structure forming apparatus according to claim 1, wherein the heater comprises:

a mounting plate, on which a medium is mountable, the medium consisting of the photo-thermal conversion material, the white material, and the coloring material printed in order on the expanding layer in the overlapping manner;

a medium supporting frame which is fixed on the mounting plate to support the medium; and a heat source which is movable along the mounting plate so as to be movable over and relative to the medium fixedly placed on the mounting plate.

10. The structure forming apparatus according to claim 9, wherein the controller is configured to adjust at least one of a moving speed of the heat source and an optical energy output from the heat source such that the optical energy emitted onto a unit area of the medium per unit time will be uniform throughout the whole medium.

* * * * *